US006502443B2

(12) United States Patent
Saito

(10) Patent No.: US 6,502,443 B2
(45) Date of Patent: Jan. 7, 2003

(54) COMPONENT ROLLING TOOL OF DYNAMIC PRESSURE GROOVE AND COMPONENT ROLLING METHOD

(75) Inventor: Shoichi Saito, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 11 days.

(21) Appl. No.: 09/899,883

(22) Filed: Jul. 6, 2001

(65) Prior Publication Data

US 2002/0002852 A1 Jan. 10, 2002

(30) Foreign Application Priority Data

Jul. 7, 2000 (JP) ..... 2000-207400

(51) Int. Cl.[7] ..... B21B 1/00

(52) U.S. Cl. ..... 72/75; 72/113; 72/370.08; 72/370.21; 29/898.13

(58) Field of Search ..... 72/75, 113, 117, 72/120, 122, 126, 370.01, 370.07, 370.08, 370.17, 370.21; 29/898.02, 898.13

(56) References Cited

U.S. PATENT DOCUMENTS 4,866,966 A * 9/1989 Hagen ..... 72/75
5,265,334 A * 11/1993 Lucier ..... 29/898.02
5,269,164 A * 12/1993 Choi ..... 72/75
5,520,038 A 5/1996 Clark et al.
5,802,900 A * 9/1998 Lee ..... 72/75
5,946,958 A * 9/1999 Clark et al. ..... 72/75

FOREIGN PATENT DOCUMENTS

JP 11-77210 3/1999

* cited by examiner

*Primary Examiner*—Ed Tolan
(74) *Attorney, Agent, or Firm*—Scully, Scott, Murphy & Presser

(57) ABSTRACT

A component rolling tool for applying a dynamic pressure groove comprising component rolling balls, cylindrical sleeve having an outer surface, an axis, a radius, a center hole, and guide holes, and being inserted into the bearing hole, and being relatively translated along the axis with respect to the bearing, and being relatively rotated about the axis with respect to the bearing, a moving roller coaxially inserted to the center hole, pressing the balls toward an outward direction of the guide holes and being moved along the axis in accordance with a pressure contact rotation between the balls and an inner peripheral surface of the bearing hole caused by a relative movement between the sleeve and the bearing, and a returning apparatus for returning the roller to an initial position at a desired timing in a state that the balls is released from a pressure contact with the inner peripheral surface.

14 Claims, 4 Drawing Sheets

COMPONENT ROLLING TOOL OF DYNAMIC PRESSURE GROOVE AND COMPONENT ROLLING METHOD

CROSS-REFERENCE TO RELATED APPLICATION

This application is based upon and claims the benefit of priority from the prior Japanese Patent Application No. 2000-207400, filed Jul. 7, 2000, the entire content of which is incorporated herein by reference.

BACKGROUND OF THE INVENTION

The present invention relates to a component rolling tool for forming a dynamic pressure groove on an inner peripheral surface of a bearing hole in a dynamic pressure bearing by moving a plurality of component rolling balls in pressure contact with the inner peripheral surface, and a component rolling method using the same.

Conventionally, a component rolling tool and method of the dynamic pressure groove using the component rolling ball have been known, for example, in Japanese Patent Application KOKAI Publication No. 11-77210.

The component rolling tool disclosed in Japanese Patent Application KOKAI Publication No. 11-77210 has a sleeve, component rolling balls, a moving roller and an urging member.

The sleeve has one end and the other end, and has a longitudinal center axis. The sleeve is formed in a hollow cylindrical shape having a center hole extending along the longitudinal center axis. The center hole is open in a side of one end of the sleeve. The sleeve has a plurality of guide holes. The component rolling ball is mounted in each of the guide holes.

The moving roller is arranged in the center hole of the sleeve so as to freely rotate about the longitudinal center axis and freely reciprocate along the longitudinal center axis, in such a manner as to be coaxial with the center hole.

The component rolling ball is pressed by the moving roller in the center hole and is protruded outward from the guide hole at a predetermined amount.

The urging member has one end and the other end and is arranged in the center hole. The urging member is provided such that one end thereof is connected to the other end of the moving roller and the other end thereof is connected to the other end in the center hole. The urging member urges the moving roller toward the other end side along the longitudinal center axis.

Then, in accordance with the component rolling method of the dynamic pressure groove using the component rolling tool, the sleeve is driven so that the sleeve is inserted to the bearing hole from an external portion of the bearing hole. Next, in a state that a plurality of component rolling balls are in pressure contact with the inner peripheral surface of the bearing hole, the sleeve is moved in a direction of the axis while being rotated about the axis. Together with this movement, the component rolling tool applies a forming of the dynamic pressure groove onto the inner peripheral surface. The component rolling method uses the component rolling tool to execute the component rolling process in the manner mentioned above. In this case, the initial position means a position at which the moving roller is arranged before starting the component rolling process.

In the conventional component rolling tool mentioned above, the component rolling ball is exposed to an external force to be rotated due to a contact with respect to the inner peripheral surface of the bearing hole at a time of forming the groove. In this case, in the component rolling tool mentioned above, the moving roller is to freely rotate about the longitudinal center axis of the component rolling tool in the center hole of the sleeve, and is to freely move to one end side along the axis. Accordingly, the component rolling ball can rotates while rotating the moving roller being in contact with the component rolling ball itself and moving the moving roller to the side of one end, in the case of being exposed to the external force. Accordingly, a load generated between the component rolling ball and the inner peripheral surface of the bearing hole does not become equal to or more than a force necessary for forming the dynamic pressure groove, so that no burr and no peeling are generated on the formed surface of the dynamic pressure groove.

The moving roller is kept being gradually moved to the side of one end due to the rotation of the component rolling ball in correspondence to the movement of the sleeve. The moving roller is forcibly urged in a direction along the axis in an opposite side to the forward moving direction of the sleeve by the urging member provided in the center hole of the sleeve in the manner mentioned above when the component rolling ball becomes in a state that the component rolling ball is not in pressure contact with the inner peripheral surface of the bearing hole in the dynamic pressure bearing, thereby being returned to the initial position.

In accordance with the component rolling tool and method of the dynamic pressure groove as mentioned above, it is possible to stabilize a quality of the formed surface of the dynamic pressure groove and it is possible to continuously form the dynamic pressure groove.

The component rolling method of the dynamic pressure groove is generally executed in accordance with the following procedure.

1. The component rolling tool is inserted to the bearing hole of the dynamic pressure bearing from the other end of the bearing hole, is forward moved along the axis, plastically works the inner peripheral surface of the bearing hole by the component rolling ball, and forms the dynamic pressure groove on the inner peripheral surface.

2. The component rolling ball temporarily moves out of the bearing hole from one end of the bearing hole.

3. The component rolling tool is rearward moved along the same path as that at a time of plastically working in the process mentioned in the item 1 (the component rolling ball moves along the same path inversely).

In accordance with this procedure, in the conventional embodiment described in Japanese Patent Application KOKAI Publication No. 11-77210, when the component rolling ball temporarily moves out of the bearing hole from the other end of the bearing hole in the manner mentioned above, the load due to the pressure contact of the inner peripheral surface of the bearing hole with respect to the component rolling ball is lost, so that the moving roller is returned to the initial position by the urging member in spite that it is not an intended timing. In this state, when rearward moving the component rolling tool in the manner mentioned above, the moving roller is moved to a position at which the moving roller can not move in a backward moving direction of the sleeve, so that the component rolling ball is hard to rotate.

Further, in the forming process of the dynamic pressure groove on the inner peripheral surface of the bearing hole, there is a case that the inner peripheral surface is not completely plastically deformed in correspondence to the outer shape of the component rolling ball only by the forward motion of the sleeve but a return back such as an elastically deformation is partly generated. Further, there is a case that there is generated a shift in view of a forming accuracy between the backward moving path of the component rolling balls and the forward moving path. Under these circumstances, in the case that the component rolling ball does not smoothly rotate, the component rolling ball during the forming on the backward moving path generates a great friction with respect to the inner peripheral surface of the bearing hole.

Further, in the component rolling method, in the case that a necessary number of the grooves to be formed is n times the number of the component rolling balls, there is a case that in order to reduce a forming man-hour, the component rolling ball moves on the different new path from the forward moving path at a time of backward moving so as to form the groove. At this time, in the case of using the conventional component rolling tool mentioned above, since the component rolling ball is, of course, hard to rotate during the forming process in the backward moving path, the component rolling ball generates a great friction with respect to the inner peripheral surface of the bearing hole in the dynamic pressure bearing.

As mentioned above, in the case that the moving roller does not move along the longitudinal center axis at a time of forming in the backward moving path, the load between the component rolling ball and the inner peripheral surface of the bearing hole to be rolled becomes equal to or greater than the force necessary for forming the dynamic pressure groove, a burr and a peeling are generated on the inner peripheral surface of the bearing hole in the dynamic pressure bearing, so that the quality of the formed surface of the dynamic pressure groove becomes unstable.

BRIEF SUMMARY OF THE INVENTION

An object of the present invention is to provide a component rolling tool which can always rotate component rolling balls when the component rolling balls move through an inner peripheral surface of a bearing hole in a dynamic pressure bearing in spite of a simple structure, can prevent a burr and a peeling from being generated on the inner peripheral surface of the bearing hole in the dynamic pressure, can form a surface to be formed of the dynamic pressure groove at a high quality for a long time, can return a moving roller to an initial position at a desired timing without requiring a troublesome operation and can continuously form the dynamic pressure groove, and a component rolling method.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitutes a part of the specification, illustrate presently preferred embodiments of the invention, and together with the general description given above and the detailed description of the preferred embodiments given below, serve to explain the principles of the invention.

DETAILED DESCRIPTION OF THE INVENTION

A description will be given below of a component rolling tool and a method of a dynamic pressure groove in accordance with various kinds of embodiments of the present invention with reference to the accompanying drawings.

(First Embodiment)

At first, a description will be given of a first embodiment with reference to FIGS. 1 and 2.

Figure 1:
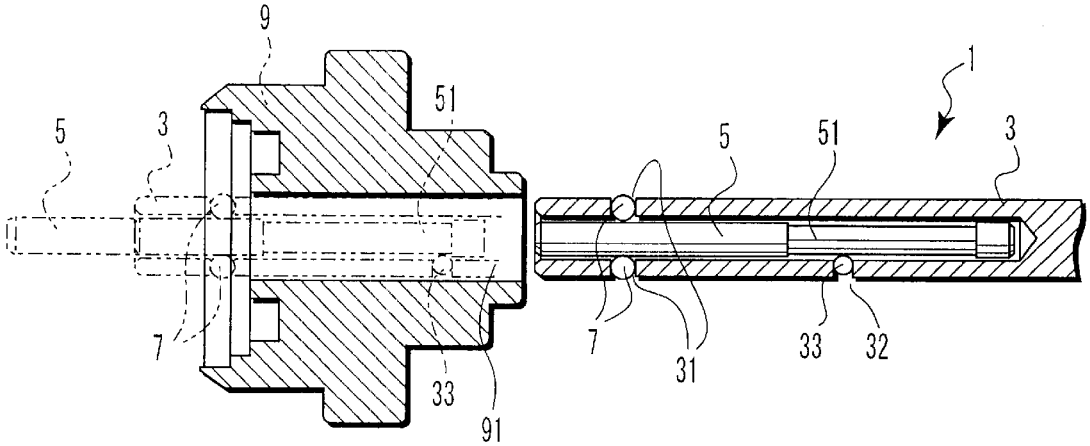
FIG. 1 is a longitudinal cross sectional view showing a state in which a component rolling tool in accordance with a first embodiment of the present invention is coaxially arranged with a dynamic pressure bearing to be rolled.
Figure 2:
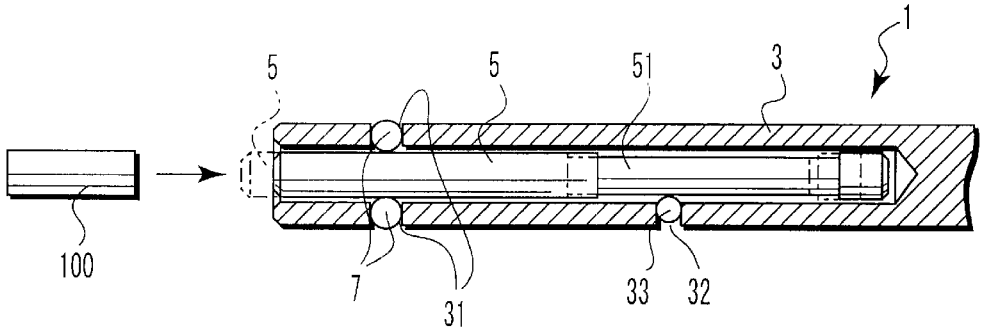
FIG. 2 is a longitudinal cross sectional view showing a state of returning a moving roller of the component rolling tool in FIG. 1 to an initial position by a returning apparatus.

FIGS. 1 and 2 are cross sectional views along a surface in parallel to a forming direction of a component rolling tool 1 in accordance with the present invention.

The component rolling tool 1 has a sleeve 3, a moving roller 5, a component rolling ball 7 and a returning apparatus 100. The component rolling tool 1 is mounted to a forming machine (not shown). The forming machine has a drive unit for driving the component rolling tool 1, and a control unit for controlling an operation of the drive unit.

The sleeve 3 has one end and the other end, an outer surface, a longitudinal center axis, and a radial direction perpendicular thereto. A horizontal cross sectional shape of the outer peripheral surface of the sleeve 3 can be freely set as far as it is not in contact with an inner peripheral surface of the bearing hole 91. The sleeve 3 has a front end (one end) in a side of a dynamic pressure bearing 9 (a left side with respect to a paper surface), and a rear end (the other end) in an opposite side (a right side with respect to the paper surface) to the front end. A center hole is provided in the sleeve 3 from the front end toward the rear end (the other end). The center hole is opened in a side of the front end, and closed in a side of the other end. The sleeve 3 is connected the drive unit at the rear end. The drive unit translates the sleeve 3 along the axis and rotates the sleeve 3 about the axis. An outer diameter of the sleeve 3 is formed to be smaller than a diameter of a bearing hole 91 of the dynamic pressure bearing 9 so as to be inserted to the bearing hole 91.

The sleeve 3 has a plurality of guide holes 31 in a radial direction of itself. More particularly, a plurality guide holes 31 extend through the sleeve 3 in the radial direction and are provided in a side of a front end of the sleeve 3 along a peripheral direction.

The component rolling balls 7 are formed in a substantially complete spherical shape, made of a sintered hard alloy, and rotatably supported to the guide holes 31 respectively. Further, the component rolling ball 7 is inserted to each of the guide holes 31.

Each of the guide holes 31 are deformed to have a hole diameter smaller than a diameter of the component rolling ball 7 in an opening in a side of the outer peripheral surface of the sleeve 3 in accordance with a caulking process or the like after the component rolling ball 7 is inserted thereto. Due to the deformation, the component rolling balls 7 are prevented from slipping out from guide holes 31 in the radial direction of the sleeve 3 respectively.

The moving roller 5 is coaxially arranged within the center hole of the sleeve 3. Further, the moving roller 5 is arranged in such a manner as to be capable of rotating about the longitudinal center axis and be capable of reciprocating along the longitudinal center axis within the center hole. Further, the moving roller 5 has a size in a longitudinal direction longer than a size in a longitudinal direction of the bearing hole 91 of the dynamic pressure bearing 9, and is made of a sintered hard alloy. An outer peripheral surface of the moving roller 5 supports each of the component rolling balls 7 with respect to the radial direction (outward direction of guide holes) in such a manner as to define a protruding amount of the component rolling ball 7 from the outer surface of the sleeve 3. I.e., each of the component rolling balls 7 is rotatably supported at a predetermined position by the outer peripheral surface of the moving roller 5 and the caulked opening of the guide hole 31. In this case, the protruding amount of each of the component rolling balls 7 is defined so that the protruding portion of the component rolling ball 7 can be in pressure contact with the inner peripheral surface of the bearing hole 91 when the sleeve 3 is inserted to the bearing hole 91.

Further the moving roller 5 have a small diameter portion 51 at rear end of itself (a right side with respect to a paper surface) along a longitudinal direction. The small diameter portion 51 has a predetermined distance longer than the moving distance of the moving roller 5 at a time of component rolling process.

The sleeve 3 has a slip-out preventing hole 32 on a peripheral wall of itself facing to the small diameter portion 51. Further the sleeve 3 has a slip-out preventing ball 33. The slip-out preventing ball 33 has a radius larger than a thickness of the sleeve 3. The slip-out preventing ball 33 is pressure inserted to the slip-out preventing hole 32 and protrudes into the center hole of the sleeve 3 from the slip-out preventing hole 32 at a predetermined amount. I.e., the slip-out preventing ball 33 has a protruding portion (a convex portion) protruding toward a space (a recess portion) defined by the small diameter portion 51 of the moving roller 5.

The convex portion and the recess portion are engaged with each other so as to restrict a moving distance of the moving roller 5 along the longitudinal center axis, whereby it is possible to prevent the moving roller 5 from slipping out from the center hole and dropping down. That is, in this embodiment, the convex portion and the recess portion mentioned above comprise a moving roller stopping mechanism for preventing the moving roller from slipping down from the sleeve 3.

The returning apparatus 100 is formed in a rod shape having a diameter smaller than a diameter of the center hole, and is arranged coaxially with the component rolling tool 1 with placed between them. The returning apparatus 100 is mounted to the forming machine and is moved toward the moving roller 5 under the control of the control unit along the longitudinal center axis in such a manner as to return the moving roller 5 to a predetermined initial position after component rolling the dynamic pressure groove.

Here, a description will be given of a motion of the component rolling tool 1 of the dynamic pressure groove in accordance with the first embodiment mentioned above.

As shown by a solid line in FIG. 1, the component rolling tool 1 is arranged, apart from the bearing hole 91 at a predetermined distance and in the concentric state with the bearing hole 91, before starting the component rolling process of the dynamic pressure groove applied to the bearing hole 91. At this time, the moving roller 5 is arranged at the initial position. This initial position means a position at which the moving roller 5 within the center hole is arranged before starting the component rolling process. In the present embodiment, the initial position means a position as shown by a solid line in FIG. 1 at which the moving roller 5 can move to the side of the front end of the sleeve 3 along the longitudinal center axis within the center hole. Said motion of the moving roller 5 in the center hole corresponds to the movement of the component rolling tool 1 of the dynamic pressure groove during the period that the dynamic pressure groove is made from one end of the bearing hole 91 to the other end thereof.

From the state mentioned above, a first groove forming process is started. In the first groove forming process, The dynamic pressure groove is applied onto the inner peripheral surface of the bearing hole 91. In the first groove forming process, at first, the sleeve 3 is inserted to the bearing hole 91 by moving the component rolling tool 1, toward the dynamic pressure bearing 9 (a left side with respect to the paper surface) along the axis, in accordance with a drive operation of the drive unit, i.e., the sleeve 3 is introduced to the bearing hole 91. Then, the sleeve 3 is advanced to at a desired position along the axis through the bearing hole 91. In other words, the sleeve 3 is translated to the front end (one end) of its i.e., to the bearing hole 91. At this time, the sleeve 3 relatively rotates about the longitudinal center axis with respect to the dynamic pressure bearing 9. Above-mentioned the introducing and advancing motion of the sleeve 3 is hereinafter, refer to a forward forming processing. Said movement direction of Sleeve 3 is a first direction at forward forming processing.

At forward forming processing, the moving roller 5 is to be capable of rotating about the longitudinal center axis and moving along the longitudinal center axis, as shown in the structure mentioned above. Accordingly, the component rolling ball 7 can rotate and be rotated and translated the moving roller 5 to the first direction due to the contact to the moving roller 5. That is, since the moving roller 5 can rotate and translate, the load of each of the component rolling balls 7 applied from the moving roller 5 is reduced and each of the component rolling balls 7 smoothly rotates. Since the component rolling ball 7 smoothly rotates in the manner mentioned above, the burr and the peeling are hard to generate on the inner peripheral surface of the bearing hole 91, and a quality of the forming surface in the dynamic pressure groove becomes stable.

When a desired dynamic pressure groove is formed on the inner peripheral surface of the bearing hole 91, a first releasing step is subsequently executed.

In this first releasing step, the drive unit finishes rotating about the longitudinal center axis, and the component rolling ball 7 moves the sleeve 3 to a position released from the inner peripheral surface of the bearing hole 91 along the longitudinal center axis. In accordance with this movement, the component rolling ball 7 becomes a released state in which no pressure is applied thereto from the bearing hole 91. In other words the component rolling 7 balls are released from the contact with the inner peripheral surface. Further, the moving roller 5 is set in a state of being most exposed from the center hole of the sleeve 3, as shown by a two-dot chain line in FIG. 1.

In the present embodiment, the slip-out preventing ball 33 protrudes to a space defined by the small diameter portion 51 of the moving roller 5. Therefore the moving roller 5 does not slip out from the center hole of the sleeve 3 even when the component rolling ball 7 keeps rotating due to inertia in the released state so as to keep moving the moving roller 5 along the longitudinal center axis. In this case, the slip-out preventing ball 33 is formed in a spherical shape, however, in place of the slip-out preventing ball 33, the moving roller stopping mechanism may be constructed by using a rod-like slip-out preventing portion as far as protruding to the space defined by the small diameter portion 51 of the moving roller 5 so as to allow the moving roller 5 to move in the direction along the axis at a predetermined distance and rotate about the axis, and prevent the moving roller 5 from slipping out from the center hole of the sleeve 3 and dripping down, or the moving roller stopping mechanism may be constructed by using a slip-out preventing portion which is integrally formed with the inner peripheral surface.

Next, a second groove forming process will be executed. In this second groove forming process, the sleeve 3 moves toward a second direction opposite to the first direction, that is, moves backward, i.e., the sleeve 3 is draw down from the bearing hole 91. Therefore the component rolling ball 7 is again inserted to contact the inner peripheral surface of the dynamic pressure bearing 9. Then, the component rolling ball 7 moves backward through substantially the same path as that of the forward forming processing (hereinafter, refer to a backward forming processing). At this time, the moving roller 5 is in a state capable of moving in a direction of being taken into the center hole as is reverse to that at the forward forming processing. Accordingly, in the same manner as that of the forward forming process, the component rolling ball 7 smoothly rotates due to no unnecessary load applied from the moving roller 5, thereby applying no deterioration to the quality of the forming surface of the dynamic pressure bearing 9. Further, since the backward forming process is executed by moving along the same path as that of the forward forming process, it is possible to smoothen the dynamic pressure groove formed by the forward forming process so as to further improve a forming quality of the dynamic pressure groove.

In this case, the backward forming process is executed by the backward translating along the same path as that of the forward forming process, however, by the rotating and backward translating the sleeve 3 after rotating the sleeve 3 about the axis at a predetermined angle so as to move the position of each of the component rolling balls 7 in the peripheral direction, it is possible to move along a different path from the forward forming path so as to execute the backward forming process. In the case of executing the backward forming process as mentioned above, the component rolling tool can form double dynamic pressure grooves the number of the component rolling balls 7. Since the component rolling ball 7 is not exposed to the unnecessary load applied from the moving roller 5 even in the forming process mentioned above, the component rolling ball 7 smoothly rotates and does not deteriorate the quality of the forming surface of the dynamic pressure groove in the dynamic pressure bearing When a desired dynamic pressure groove is formed on the inner peripheral surface of the bearing hole 91, a second releasing step is subsequently executed.

In this second releasing step, the sleeve 3 is moved along the longitudinal center axis until the position at which the drive unit finishes rotating about the longitudinal center axis and the component rolling balls 7 are released from the inner peripheral surface of the bearing hole 91, and the movement mentioned above is finished. In accordance with this movement, the component rolling ball 7 becomes in a released state not exposed to the pressure applied from the external portion.

As mentioned above, in the forward forming process and the backward forming process, within the center hole of the sleeve 3, the moving roller 5 is moved apparatus 100. In accordance with this operation, the returning apparatus 100 presses the moving roller 5 to the initial position shown by the solid line in FIG. 2 so as to supplement the lack of return for returning the moving roller 5 to the initial position.

In this case, in the returning step, the moving roller 5 returns to the initial position from the state protruding from the sleeve 3. However, since the returning apparatus 100 has a diameter smaller than that of the center hole of the sleeve 3, the returning apparatus 100 can be inserted to the center hole and can return the moving roller 5 (which does not protrudes from the sleeve 3) in the center hole to the initial position.

Further, in order to obtain the effect mentioned above, the returning apparatus 100 can be formed in a convex shape in which a diameter is smaller than that of the center hole only at the front end inserted to the center hole of the sleeve 3, and the shape of the returning apparatus is not limited as far as the returning apparatus can return the moving roller 5 to the predetermined initial position.

Further, in the present embodiment, the sleeve 3 is translated and rotated, whereby the component rolling tool 1 applies the component rolling process to the fixed dynamic pressure bearing 9, however, the component rolling process may be executed by along the axis while rotating about the axis. However, since an amount of force at which the component rolling ball 7 is in pressure contact with the inner peripheral surface of the bearing hole 91 is different between the forward forming process and the backward forming process mentioned above, the moving distance along the axis of the moving roller 5 is not the same. Accordingly, when the second releasing step is finished, as shown by a two-dot chain line in FIG. 2, the position along the axis is not returned to an initial position shown by solid lines in FIGS. 1 and 2 at a time of starting the component rolling process and a lack of return is generated. Accordingly, next, a returning step of returning the moving roller 5 to the predetermined initial position is executed.

In this returning step, the moving roller 5 is returned to the initial position from the state protruding from the center hole of the sleeve 3 (as shown by the two-dot chain line in FIG. 2). In the returning step, the drive unit and/or the returning apparatus 100 are controlled the control unit by a predetermined program at a time of finishing the second releasing step.

The returning apparatus 100 relatively moves toward the moving roller 5 protruding from the sleeve 3 on the control mentioned above so as to press the front end of the moving roller 5 against the returning translating and rotating the dynamic pressure bearing 9 in a state of fixing the sleeve 3. Further, the component rolling tool 1 in accordance with the present embodiment can execute the component rolling process by translating and rotating both of the sleeve 3 and the dynamic pressure bearing 9. That is, the component rolling tool 1 in accordance with the present embodiment is not limited in view of the operation of the sleeve 3 and the dynamic pressure bearing 9 as far as the component rolling tool 1 can relatively translate and rotate the sleeve 3 with respect to the dynamic pressure bearing 9.

As mentioned above, in accordance with the component rolling tool 1 of the dynamic pressure groove of the present embodiment, immediately before forming the next dynamic pressure groove, it becomes a state in which the dynamic pressure groove can be formed in the same manner as the previously formed dynamic pressure bearing, and the dynamic pressure groove can be continuously applied to the bearing hole 91 in an always uniform state.

Further, in the component rolling tool 1 of the dynamic pressure groove in accordance with the present embodiment, since it is not necessary to provide the other particular means as the returning means to the initial bearing 9 in the dynamic pressure bearing 9, the dynamic pressure bearing 9 can be put into practice by a simple structure.

Further, since the other member for returning the moving roller 5 to the initial position is not provided between the front end of the sleeve 3 and the component rolling ball 7 along the axis, it is possible to restrict the distance between the front end of the sleeve 3 and the component rolling ball 7 to a minimum limit. Accordingly, it is possible to prevent the inner peripheral surface of the dynamic pressure bearing 9 and the front end of the sleeve 3 from being in contact due to warp of the sleeve 3 or the like.

In this case, the dynamic pressure groove formed by the component rolling tool 1 can be formed in a desired shape and size by adjusting a moving speed (rotational and translational speed) of the drive unit for the sleeve 3, a protruding amount of the component rolling ball 7 from the guide hole 31, and the like.

(Second Embodiment)

A description will be given below of a component rolling tool 10 of a dynamic pressure groove in accordance with a second embodiment of the present invention with reference to FIG. 3. In this case, in a component rolling tool 10 of the dynamic pressure groove, the same reference numerals are attached to the same elements as the elements of the component rolling tool 1 of the dynamic pressure groove in accordance with the first embodiment of the present invention mentioned above, and a detailed description thereof will be omitted.

The component rolling tool 10 in accordance with the second embodiment is characterized in that a chamber 201 and a returning apparatus 200 for controlling an air pressure within the chamber 201 are provided in a side of the other end opposite to the front end of the sleeve 3. The component rolling tool 10 is shown by solid line in FIG. 3.

The chamber 201 defined by the moving roller 5 and the inner surface of the sleeve 3. The chamber 201 has an air pressure adjusting hole 203 on a peripheral wall of itself. The air pressure adjusting hole 203 is provided on a side wall in the side of the other end of the center hole. The air pressure adjusting hole 203 has a returning apparatus connecting portion 204 connected to the returning apparatus 200 in an opening in the side of the outer peripheral surface of the sleeve 3.

The returning apparatus 200 has an air pressure adjusting apparatus 202 such as an air compressor, and a chamber connecting portion 205 for connecting the air pressure adjusting apparatus 202 to the returning apparatus connecting portion 204. The returning apparatus 200 is operated so as to adjust the air pressure in the chamber 201 by a signal of the control unit.

Here, a description will be given of an operation of the component rolling tool 10 of the dynamic pressure groove in accordance with the present embodiment. The component rolling tool 10 is coaxially arranged with the dynamic pressure bearing 9 in the same manner as that of the component rolling tool 1 in accordance with the first embodiment, before starting the forming process of the dynamic pressure groove applied to the bearing hole 91. Then, in this stage, the adjusting apparatus 202 is not connected to the chamber 201. Accordingly, since the chamber 201 is an open state (not corresponding to a sealed state) by the air pressure adjusting hole 203, the pressure in the chamber 201 is the same as the atmospheric pressure (a air pressure out of the component rolling tool 10). Therefore, the moving roller 5 is not exposed to the application of the air pressure in the chamber 201 and is set in a state capable of moving along the axis in the same manner as that of the moving roller 5 in accordance with the first embodiment.

In the state mentioned above, in the same manner as that of the first embodiment, the first groove forming step, the first releasing step, the second groove forming step and the second releasing step are executed.

Figure 3:
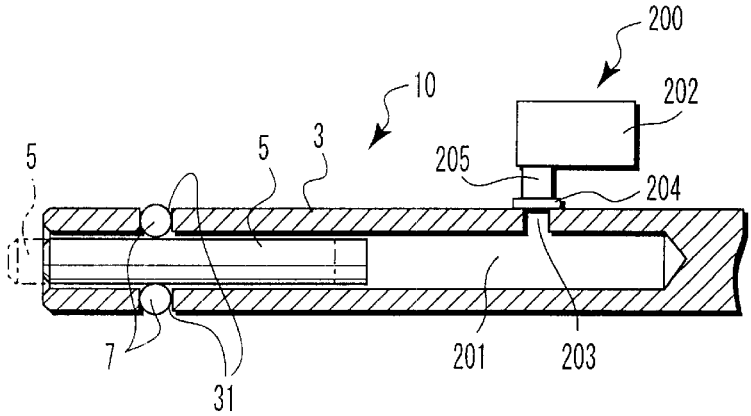
FIG. 3 is a longitudinal cross sectional view of a component rolling tool in accordance with a second embodiment of the present invention.

When the second releasing step mentioned above is finished, the moving roller 5 does not return to the initial position shown by a solid line in FIG. 3 in the same manner as that of the first embodiment, so that the returning step is executed.

In the returning step in accordance with the present embodiment, at first, the chamber connecting portion 205 of the returning apparatus 200 is connected to the returning apparatus connecting portion 204 in a state of finishing and stopping the movement due to the control of the control unit or the like. Next, the air pressure adjusting apparatus 202 can suck the air within the chamber 201, descend the air pressure within the chamber 201 and return the moving roller 5 which is not positioned at the initial position shown by the two-dot chain line in FIG. 3, to the initial position. The suction of the air in the air pressure adjusting apparatus 202 is finished when the moving roller 5 returns to the initial position in accordance with the control of the control unit. Then, the chamber connecting portion 205 is taken out from the returning apparatus connecting portion 204 of the air pressure adjusting hole 203.

As mentioned above, the component rolling tool 10 in accordance with the present embodiment becomes in a state capable of forming the dynamic pressure groove in the same manner as the preceding forming process of the dynamic pressure groove immediately before forming the next dynamic pressure groove, so that it is possible to always apply the continuous forming process of the dynamic pressure groove to the bearing hole 91 in the same state.

In accordance with the present embodiment, the returning apparatus 200 returns the moving roller 5 to the initial position by adjusting the air pressure within the chamber 201. However, it is also possible to return the moving roller 5 to the initial position by previously charging a fluid such as the other gas than the air or a liquid into the chamber 201 and adjusting a pressure of the fluid within the chamber 201 by the returning apparatus 200.

In this embodiment, in the same manner as that of the first embodiment, it is also possible to provide with a moving roller stopping mechanism for preventing the moving roller 5 from slipping out from the center hole of the sleeve 3.

(Third Embodiment)

A description will be given below of a component rolling tool 11 of a dynamic pressure groove in accordance with a third embodiment of the present invention with reference to FIG. 4. In this case, in the component rolling tool 11 of the dynamic pressure groove, the same reference numerals are attached to the same elements as the elements of the component rolling tool 1 of the dynamic pressure groove in accordance with the first embodiment of the present invention mentioned above, and a detailed description thereof will be omitted.

The component rolling tool 11 in accordance with the third embodiment comprises such that the sleeve 3 is made of a non-magnetic substance and the moving roller 5 is made of a magnetic substance. Further, the component rolling tool 1 is provided with a returning apparatus 300 for returning the moving roller 5 to the initial position due to an electromagnetic drive force in a side of the other end (a rear end) opposite to the front end of the sleeve 3.

A rear end (a right side with respect to the paper surface) of the moving roller 5 is formed in a convex shape.

The returning apparatus 300 has a coil 301 and an attraction member 302. The coil 301 wounds around an outer peripheral surface of the sleeve 3 and fixed thereto. The attraction member 302 is magnetic substance. The attraction member 302 is arranged within the coil 301 and fixed sleeve 3. In the front end opposing to the moving roller 5, the attraction member 302 has a recess. The recess is shaped to fit the convex shape at the rear end of the moving roller 5. In this embodiment, as shown by a solid line in FIG. 4, the initial position of the moving roller 5 is that the rear end of the moving roller 5 and the front end of the attraction member 302 contact with each other.

Here, a description will be given of an operation of the component rolling tool 11 in accordance with the present embodiment.

The component rolling tool 11 is arranged with respect to the bearing hole 91 in the same manner as that of the component rolling tool 1 in accordance with the first embodiment, before starting the forming process of the dynamic pressure groove applied to the bearing hole 91. Then, in this stage, since no electric current is applied to the coil 301, the attraction member 302 is not magnetized. Accordingly, the moving roller 5 is capable of freely moving along the longitudinal center axis in the same manner as that of the moving roller 5 in accordance with the first embodiment.

In the same manner as that of the first embodiment, a first groove forming step, a first releasing step, a second groove forming step and a second releasing step are executed.

Figure 4:
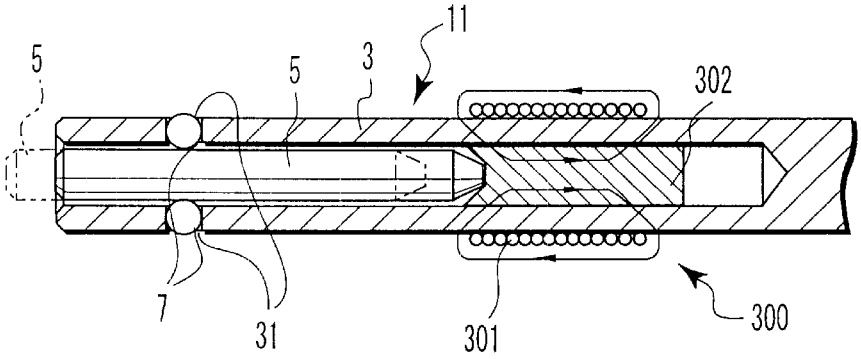
FIG. 4 is a longitudinal cross sectional view of a component rolling tool in accordance with a third embodiment of the present invention.

When the second releasing step mentioned above is finished, the returning step is executed since the moving roller 5 does not return to the initial position as shown by a two-dot chain line in FIG. 4 in the same manner as that of the first embodiment.

In the returning step in accordance with the present embodiment, at first, the electric current is applied to the coil 301 of the returning apparatus 300 in accordance with a control of the control unit. Accordingly, since the attraction member 302 is magnetic substance, the attraction member 302 is magnetized so as to attract the moving roller 5 due to a magnetic force, thereby returning the moving roller 5 to the initial position. In other words, the attraction member 302 can return the moving roller 5 to the initial position due to the electromagnetic drive force.

In accordance with the present embodiment, since the rear end of the moving roller 5 is formed in the convex shape and the front end of the attraction member 302 is formed in the recess shape as mentioned above, it is possible to increase a magnetic flux applied to each other in comparison with the case that the rear end and the front end are formed in a flat shape, whereby it is possible to more securely attract. The attraction of the moving roller 5 by the attraction member 302 is finished when the moving roller 5 returns to the initial position. Then, the electric current applied to the coil 301 is shut.

In this case, when the moving roller 5 moving in accordance with the attraction mentioned above reaches the initial position, the rear end of the moving roller 5 strikes the attraction member 302, whereby the moving roller 5 does not move in a direction of the rear end any more and can be securely returned to the predetermined initial position. Further, the initial position can be set to a position close to the side of the front end of sleeve 3 rather than the front end of attraction member 302. The arrangement of the moving roller 5 can be achieved by controlling the attraction of the moving roller 5 by the attraction member 302 of the returning apparatus 300 so as to stop the moving roller 5 at the desired position or providing a stop member for the moving roller 5 in front of the front end of the coil 301. Accordingly, the moving roller 5 is prevented from moving to the side of the rear end over the predetermined position, whereby the arrangement mentioned above can be achieved.

As mentioned above, the component rolling tool 11 in accordance with the present embodiment becomes in a state capable of executing the forming process of the dynamic pressure groove in the same manner as the preceding forming process of the dynamic pressure groove immediately before forming the next dynamic pressure groove, so that it is possible to continuously apply the forming process of the dynamic pressure groove to the bearing hole 91 always in the same state. In this embodiment, in the same manner as that of the first embodiment, it is also possible to provide with the moving roller stopping mechanism for preventing the moving roller 5 from slipping out from the center hole of the sleeve 3.

(Fourth Embodiment)

Next, a description will be given of a component rolling tool 12 of a dynamic pressure groove in accordance with a fourth embodiment of the present invention with reference to FIG. 5.

The component rolling tool 12 is provided in the same manner as that of the component rolling tool 11 in accordance with the third embodiment except the moving roller 5 and a returning apparatus 400. In this case, the same reference numerals are attached to the same elements as the elements of the component rolling tool 11 of the dynamic pressure groove in accordance with the third embodiment, and a detailed description thereof will be omitted.

The moving roller 5 in accordance with the present embodiment is magnetic substance in the same manner as that of the moving roller 5 in accordance with the third embodiment. Further, a step portion 52 is provided in a substantially middle portion in a longitudinal direction thereof in the moving roller 5, and a small diameter portion 53 having a smaller outer diameter extends from the step portion 52 toward the backward portion along the axis.

The returning apparatus 400 in accordance with the present embodiment includes a coil 401 fixed to the inner peripheral surface of the center hole. The coil 401 is coaxially arranged with the small diameter portion 53.

Here, a description will be given of an operation of the component rolling tool 12 in accordance with the present embodiment.

The component rolling tool 12 is arranged with respect to the bearing hole 91 in the same manner as that of the component rolling tool 11 in accordance with the third embodiment, before starting the forming process of the dynamic pressure groove applied to the bearing hole 91. In this stage, since no electric current is applied to the coil 401, a magnetic force is not generated. Accordingly, the moving roller 5 is capable of freely moving along the longitudinal center axis in the same manner as that of the moving roller 5 in accordance with the third embodiment.

In the state mentioned above, in the same manner as that of the third embodiment, a first groove forming step, a first releasing step, a second groove forming step and a second releasing step are executed.

Figure 5:
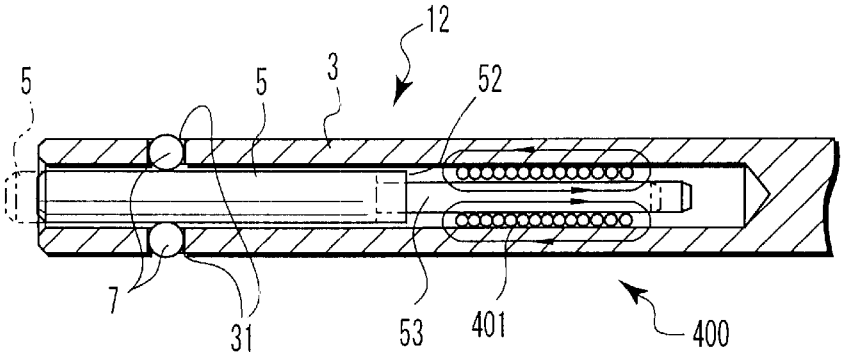
FIG. 5 is a longitudinal cross sectional view of a component rolling tool in accordance with a fourth embodiment of the present invention.

When the second releasing step mentioned above is finished, the returning step is executed since the moving roller 5 does not return to the initial position as shown by a solid line in FIG. 5 in the same manner as that of the third embodiment.

In the returning step in accordance with the present embodiment, at first, the electric current is applied to the coil 401 of the returning apparatus 400 in accordance with a control of the control unit. Accordingly, the coil 401 generates a magnetic flux and attracts the small diameter portion 53 of the moving roller 5 due to the magnetic force. Due to this attraction, it is possible to return the moving roller 5 shifted from the initial position to the initial position as shown in a two-dot chain line in FIG. 5. When the moving roller 5 returns to the initial position due to the attraction of the moving roller 5 by the coil 401, the electric current applied to the coil 401 is shut and the attracting operations finished.

In this case, when the moving roller 5 is moved to the initial position in accordance with the attraction mentioned above and reaches the initial position, the small diameter portion 53 of the moving roller 5 is completely inserted into the coil 401. Thereby a magnetic field of the returning apparatus 400 becomes stable and the attracting force becomes about 0. Accordingly, the moving roller 5 does not move to the side of the rear end of the sleeve 3 any more, and is returned to the initial position mentioned above. Further, the initial position can be set to a position close to the side of the front end of sleeve 3 rather than the portion of which the small diameter portion 53 is completely inserted into the coil 401. The arrangement of the moving roller at the position mentioned above can be achieved by controlling the attraction of the moving roller 5 by the coil 401 so as to stop the moving roller 5 at the desired position or providing with a moving roller stopping mechanism in front of the coil 401 within the center hole of the sleeve 3. Accordingly, the moving roller 5 is prevented from moving to the side of the rear end over the predetermined position, whereby the arrangement mentioned above can be achieved.

As mentioned above, the component rolling tool 12 in accordance with the present embodiment becomes in a state capable of executing the forming process of the dynamic pressure groove in the same manner as the preceding forming process immediately before forming the next dynamic pressure groove, so that it is possible to continuously apply the forming process of the dynamic pressure groove to the bearing hole 91 always in the same state. In this case, in this embodiment, in the same manner as that of the first embodiment, it is also possible to provide with the moving roller stopping mechanism for preventing the moving roller 5 from slipping out from the center hole of the sleeve 3.

(Fifth Embodiment)

Figure 6:
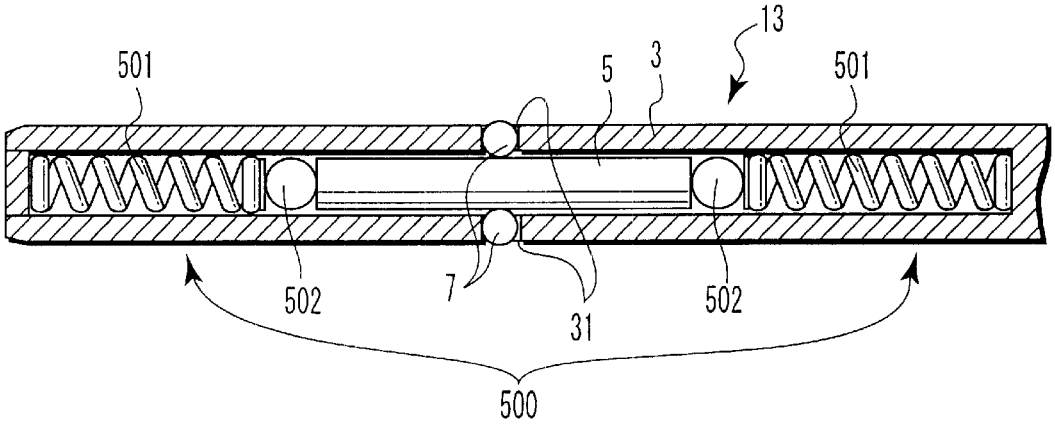
FIG. 6 is a longitudinal cross sectional view of a component rolling tool in accordance with a fifth embodiment of the present invention.

A description will be given below of a component rolling tool 13 in accordance with a fifth embodiment of the present invention with reference to FIG. 6. In this case, the same reference numerals are attached to the same elements as the elements of the component rolling tool 1 in accordance with the first embodiment, and a detailed description thereof will be omitted.

In the component rolling tool 13 in accordance with the fifth embodiment, a front end and a rear end of the center hole in the sleeve 3 are closed. Further, a plurality of guide holes 31 are formed near a substantially center in the longitudinal direction of the sleeve 3. The moving roller 5 is arranged near a substantially center in the longitudinal direction of the sleeve 3. The moving roller 5 supports the component rolling balls 7 within guide holes 31. Further, the moving roller 5 has a returning apparatus 500 for returning to the initial position.

The returning apparatus 500 has a pair of urging members 501 provided such that ends thereof are respectively fixed to both ends of the center hole in the sleeve 3 and the respective other ends support both ends along the longitudinal center axis via a supporting ball 502 from both sides in a direction along the axis. A pair of urging members 501 are respectively, for example, compression coil springs.

Here, a description will be given of an operation of the component rolling tool 13 in accordance with the present embodiment. The moving roller 5 is pressed by a pair of urging members 501 arranged in both ends within the center hole of the sleeve 3, whereby the component rolling tool 13 is held at a position where a force balance is secured, before starting the forming process of the dynamic pressure groove applied to the bearing hole 91. In this case, in the present embodiment, the initial position means that before starting the component rolling process of the dynamic pressure groove, the moving roller 5 is arranged so that the component rolling ball 7 is brought into contact with the center of the moving roller 5 itself and the moving roller 5 can move to both sides along the axis. Here, in the case that the component rolling tool 13 is provided as shown in FIG. 6, the initial position corresponds to the position at which the moving roller 5 is arranged in a substantially center in the longitudinal direction of the center hole due to the force balance of a pair of urging members 501 as mentioned above.

In executing the component rolling process, in accordance with a component rolling method of the dynamic pressure groove of the prevent embodiment, at first, a first groove forming step is executed. In the first groove forming step, in the same manner as that of the first embodiment, the sleeve 3 of the component rolling tool 13 is inserted to the bearing hole 91 and the dynamic pressure groove is formed by pressing the component rolling ball 7 onto the inner peripheral surface of the bearing hole 91. At this time, the moving roller 5 is moved in the forward forming direction (the first direction) in accordance with the rotation of the component rolling ball 7 which is in pressure contact with the inner peripheral surface of the bearing hole 91. In this case, a contact portion of the component rolling ball 7 with the moving roller 5 during the forward forming process is only a rear half portion (a right half portion with respect to the paper surface) of the outer peripheral surface of the moving roller 5. Further, in correspondence to the movement in the forward forming direction of the moving roller 5, the urging member 501 in the side of the front end of the sleeve 3 is compressed.

When the first groove process is finished, in the same manner as that of the first embodiment, a first releasing step is executed. When the first releasing step is finished, a first returning step is executed.

The first returning step is executed at the same time when the moving roller 5 is released from the pressure applied from the inner peripheral surface of the bearing hole 91 by the component rolling ball 7. At the same time when the moving roller 5 is released from the pressure applied from the component rolling ball 7 as mentioned above, the urging member 501 is exposed to no load applied from the moving roller 5. Accordingly, the front urging member 501 moves the moving roller 5 toward the initial position due to the urging force. At this time, there is a case that the moving roller 5 urged by the urging force of the urging member 501 excessively moves rearward along the axis from the initial position. In this case, the rear urging member 501 presses back the moving roller 5 forward. Then, the moving roller 5 is returned to the initial position shown in FIG. 6 corresponding to a position at which the urging force applied by a pair of urging members 501 is again balanced in the same manner as that before starting the component rolling process, and the moving roller 5 again returns to the state capable of moving both sides along the longitudinal center axis.

Next, the second groove forming step is executed in the same manner as that of the first embodiment. In this second groove forming step, in an opposite manner to that of the first groove forming step, the component rolling tool 13 is moved in a backward direction (the second direction). In this backward forming process, the moving roller 5 can move to both sides along the longitudinal center axis. However, the moving roller 5 is moved in a backward direction by the component rolling ball 7. Accordingly, the contact portion of the component rolling ball 7 during the backward forming process with the moving roller 5 is only a front half portion (a left half portion with respect to the paper surface) of an outer peripheral surface of the moving roller 5. Further, the urging member 501 in the side of the rear end of the center hole is compressed according to the movement of the moving roller 5 in the backward forming direction.

When the second groove forming step is finished, the second releasing step is executed in the same manner as that of the first embodiment. When the second releasing step is finished, the second returning step is executed.

In this second returning step, the moving roller 5 is returned to the initial position in accordance that the urging member 501 in the side of the rear end restores from the compression state, in the same manner as the first returning step. At this time, in the same manner as the case of the first returning step, there is a case that the moving roller 5 excessively moves forward along the axis from the initial position due to the urging force of the urging member in the side of the rear end. In this case, the urging member 501 in the side of the front end presses back the moving roller 5 backward and the moving roller 5 is again returned to the initial position at which the urging force applied by a pair of urging forces 501 is balanced in the same manner as that before starting the forming process. Accordingly, the moving roller 5 is again returned to the state capable of moving to both sides along the axis.

As mentioned above, in accordance with the component rolling tool 13 the present embodiment, immediately before forming the next dynamic pressure groove, it becomes a state in which the dynamic pressure groove can be formed in the same manner as the preceding forming process of the dynamic pressure bearing, and the dynamic pressure groove can be continuously applied to the bearing hole 91 in an always uniform state.

Further, in the component rolling tool 13, since it is not necessary to provide the other particular means as the returning means to the initial portion in the dynamic pressure bearing 9, the dynamic pressure bearing 9 can be put into practice by a simple structure.

Further, in the component rolling tool 13 in accordance with the present embodiment, the contact portion between the moving roller 5 and the component rolling balls 7 is different between the forward forming process and the backward forming process, as mentioned above. Accordingly, in accordance with the component rolling tool 13 of the present embodiment, the contact portion is two times from the case that the contact portion is the same between the forward and backward forming process. Therefore, it is possible to prevent the moving roller 5 from being rapidly abraded and it is possible to stably roll the dynamic pressure groove for a long time.

(Sixth Embodiment)

Figure 7:
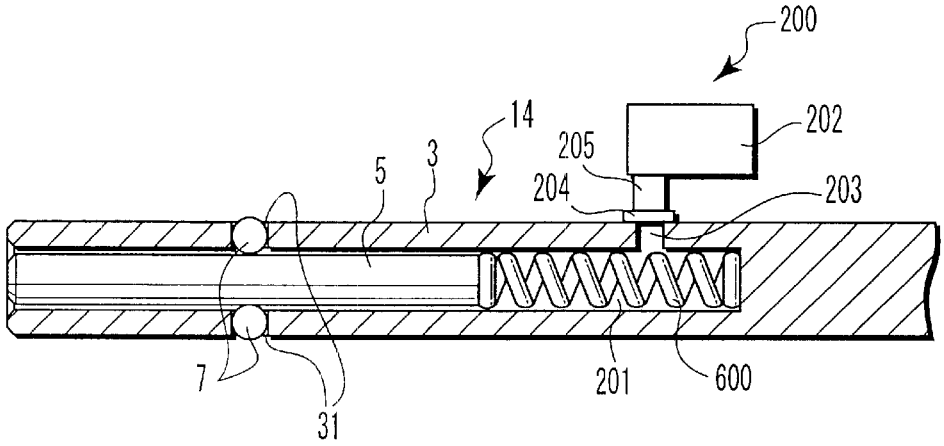
FIG. 7 is a longitudinal cross sectional view of a component rolling tool in accordance with a sixth embodiment of the present invention.

A description will be given below of a component rolling tool 14 of a dynamic pressure groove in accordance with a sixth embodiment of the present invention with reference to FIG. 7. The component rolling tool 14 of the dynamic pressure groove in accordance with the present embodiment further has an urging member 600 for moving the moving roller 5 due to an urging force in addition to the same elements as those of the component rolling tool 10 in accordance with the second embodiment. In this case, the same reference numerals are attached to the same elements in the component rolling tool 14 of the dynamic pressure groove as the elements of the component rolling tool 10 of the dynamic pressure groove in accordance with the second embodiment of the present invention mentioned above, and a detailed description thereof will be omitted.

The urging member 600 is provided such that one end is fixed to the rear end within the center hole of the sleeve 3 and the other end is brought into contact with the rear end of the moving roller 5 at the initial position. The urging member 600 is, for example, a compression coil spring. The initial position corresponds to a position at which the moving roller 5 presses the component rolling ball 7 toward the guide hole 31 in the radial direction near the center in the longitudinal direction thereof and can move to both sides along the longitudinal center axis, in the same manner as the initial position in accordance with the fifth embodiment.

Here, a description will be given of an operation of the component rolling tool 14 in accordance with the present embodiment. In the component rolling tool 14, a first groove forming step and a first releasing step are executed in the same manner as the operation of the component rolling tool 10 of the dynamic pressure groove in accordance with the second embodiment shown in FIG. 3. In this case, in the present embodiment, the moving roller 7 at the initial position shown in FIG. 7 presses the component rolling ball 7 near the center in the longitudinal direction thereof. Accordingly, in the first groove forming step, the pressure contact portion of the moving roller 5 with which the component rolling ball 7 is in pressure contact is only the rear half portion of the outer peripheral surface of the moving roller 5. When the first grooving step is finished, the first releasing step is executed. Then, the first returning step is executed.

In the first returning step in accordance with the present embodiment, in the same manner as that of the returning step in accordance with the second embodiment mentioned above, the chamber connecting portion 205 of the returning apparatus 200 is connected to the returning apparatus connecting portion 204 of the air pressure adjusting hole 203. Then, the air pressure adjusting apparatus 202 of the returning apparatus 200 can suck the air within the chamber 201. The returning apparatus 200 descend the air pressure within the chamber 201 due to the suction and moves the moving roller 5 which moves forward from the initial position in the first releasing step, toward the initial position. At this time, there is a risk that the moving roller 5 moved by the returning apparatus 200 excessively moves backward along the axis from the initial position. In this case, the urging member 600 presses back the moving roller 5 forward so as to return to the same initial position as that before starting the component rolling process, whereby the moving roller 5 is again returned to the state capable of moving to both sides along the longitudinal center axis.

Subsequently, in the same manner as that of the second embodiment shown in FIG. 3, the second groove forming step is executed. At this time, the moving roller 5 moves in the backward moving direction while pressing the urging member 600. Accordingly, the urging member 600 becomes in the compressed state. In this case, at a time of starting the second groove forming step, the moving roller 5 returns to the initial position as mentioned above. Therefore, the pressure contact portion of the moving roller 5 with which the component rolling ball is in pressure contact during the movement in the backward moving direction is only the front half portion of the outer peripheral surface of the moving roller 5 opposite to that in the first groove forming step mentioned above. When the first returning step is finished, the second groove forming step is executed.

Subsequently, in the same manner as that of the second embodiment, the second releasing step is executed. When the second releasing step is finished, the second returning step is executed.

In the second returning step in accordance with the present embodiment, since the load to the moving roller 5 applied by the component rolling ball 7 is cancelled at the same time when the second releasing step is finished, the urging member 600 compressed in the second groove forming step is restored so as to press back the moving roller 5 to the initial position. Accordingly, the moving roller 5 is again returned to the same initial position as that before starting the component rolling process so as to be again returned to the state capable of moving to both sides along the longitudinal center axis.

As mentioned above, in accordance with the component rolling tool 14, immediately before forming the next dynamic pressure groove, it becomes a state in which the dynamic pressure groove can be formed in the same manner as the preceding forming process of the dynamic pressure bearing, and the dynamic pressure groove can be continuously applied to the bearing hole 91 in an always uniform state.

As mentioned above, since the pressure contact portion of component rolling balls 7 in the moving roller 5 is different between the forward forming process and the backward forming process, the contact portion of the moving roller 5 becomes double. Therefore, it is possible to prevent the moving roller 5 from being rapidly abraded and it is possible to stably roll the dynamic pressure groove for a long time.

Figure 8:
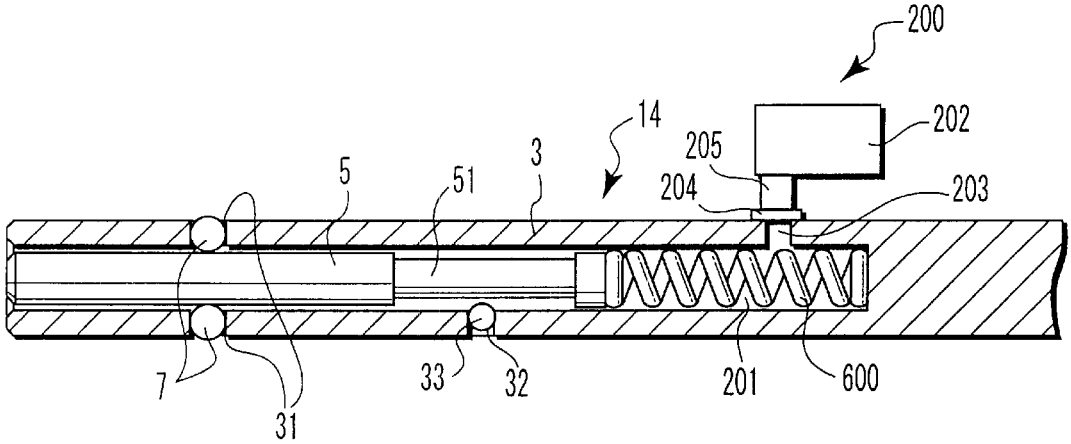
FIG. 8 is a longitudinal cross sectional view showing a modified embodiment of the component rolling tool in accordance with the sixth embodiment of the present invention.

In this case, in accordance with this embodiment, in the same manner as that of the first embodiment, it is also possible to provide with the moving roller stopping mechanism for preventing the moving roller 5 from slipping out from the center hole of the sleeve 3, as shown in FIG. 8.

(Seventh Embodiment)

A description will be given below of a component rolling tool 15 of a dynamic pressure groove in accordance with a seventh embodiment of the present invention with reference to FIG. 9. The component rolling tool 15 in accordance with the present embodiment further has an urging member 700 for moving the moving roller 5 due to an urging force in addition to the same elements as those of the component rolling tool 11 in accordance with the third embodiment shown in FIG. 4. In this case, the same reference numerals are attached to the same elements as the elements of the component rolling tool 11 in accordance with the third embodiment of the present invention mentioned above with reference to FIG. 4, and a detailed description thereof will be omitted.

The attraction member 302 of the returning apparatus 300 in accordance with the present embodiment is not fixed to the inner peripheral surface within the center hole of the sleeve 3, and is provided in such a manner as to be slidable along the longitudinal center axis within the center hole.

The urging member 700 has one end and the other end and is provided such that one end is fixed to the rear end within the center hole of the sleeve 3 and the other end is connected to the rear end of the attraction member 302. The urging member 700 is, for example, a compression coil spring. A convex portion of the rear end of the moving roller 5 is brought into contact with a recess portion in the front end of the attraction member 302 at an initial position. This initial position corresponds to a position at which the moving roller 5 presses the component rolling ball 7 toward the guide hole 31 in the radial direction near the center in the longitudinal direction thereof and can move to both sides along the longitudinal center axis, in the same manner as the initial position of the moving roller 5 in accordance with the fifth embodiment shown in FIG. 6.

Here, a description will be given of an operation of the component rolling tool 15 in accordance with the present embodiment. In the component rolling tool 15, in the same manner as the operation of the component rolling tool 11 in accordance with the third embodiment shown in FIG. 4, a first groove forming step and a first releasing step are executed. In this case, in the present embodiment, since the moving roller 7 is positioned near the center in the longitudinal direction of the moving roller 5, the pressure contact portion of the moving roller 5 with which the component rolling ball 7 is in pressure contact in the first groove forming step is only the rear half portion of the outer peripheral surface of the moving roller 5. When the first grooving step is finished, the first releasing step is executed. Then, the first returning step is executed.

Figure 9:
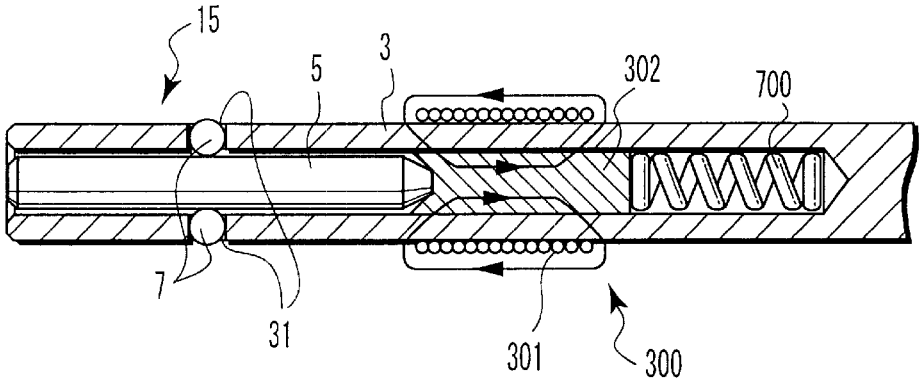
FIG. 9 is a longitudinal cross sectional view of a component rolling tool in accordance with a seventh embodiment of the present invention.

In the returning step in accordance with the present embodiment, in the same manner as that of the returning step in accordance with the third embodiment mentioned above, at first, the electric current is applied to the coil 301 of the returning apparatus 300, and the magnetized attraction portion 302 attracts the moving roller 5 positioned in front of the initial position in the first releasing step so as to return the moving roller 5 to the initial position shown by a solid line in FIG. 9. When the rear end of the moving roller 5 is brought into contact with the front end of the attraction member 302, the electric current applied to the coil 301 is shut and the attraction of the moving roller 5 executed by the attraction member 302 of the returning apparatus 300 is finished.

At this time, there is a case that the moving roller 5 urged by the returning apparatus 300 excessively moves rearward along the longitudinal center axis from the initial position. However, in this case, the urging member 700 presses back the moving roller 5 via the attraction member 302. As a result, the moving roller 5 again returns to the position of the moving roller 5 toward the same initial position as that before starting the component rolling process, and is again returned to the state capable of moving to both sides along the longitudinal center axis.

Subsequently, in the same manner as that of the third embodiment, the second groove forming step is executed. At this time, the moving roller 5 moves in the backward moving direction while pressing the urging member 700. Accordingly, the urging member 700 becomes in a compressed state. In this case, at a time of starting the second groove forming step, the moving roller 5 returns to the initial position as mentioned above. Therefore, the pressure contact portion between the component rolling ball 7 and the outer peripheral surface of the moving roller 5 during the movement in the backward moving direction is only the front half portion of the outer peripheral surface of the moving roller 5 opposite to that in the first groove forming step. When the first returning step is finished, the second groove forming step is executed.

Subsequently, in the same manner as that of the third embodiment, the second releasing step is executed. When the second releasing step is finished, the second returning step is executed.

In the second returning step in accordance with the present embodiment, since the load to the moving roller 5 applied by the component rolling balls 7 is cancelled at the same time when the second releasing step is finished, the urging member 700 compressed in the second groove forming step is restored so as to press back the moving roller 5 to the initial position. Accordingly, the moving roller 5 is again returned to the same initial position as that before starting the component rolling process so as to be again returned to the state capable of moving to both sides along the longitudinal center axis.

As mentioned above, the component rolling tool 14 becomes a state in which the dynamic pressure groove can be formed in the same manner as the preceding forming process of the dynamic pressure bearing immediately before forming the next dynamic pressure groove, and the dynamic pressure groove can be continuously applied to the bearing hole 91 in an always uniform state.

As mentioned above, since the pressure contact portion of the component rolling balls 7 in moving roller 5 is different between the forward forming process and the backward forming process, the contact portion of the moving roller 5 becomes double. Therefore, it is possible to prevent the moving roller 5 from being rapidly abraded and it is possible to stably roll the dynamic pressure groove for a long time.

Figure 10:
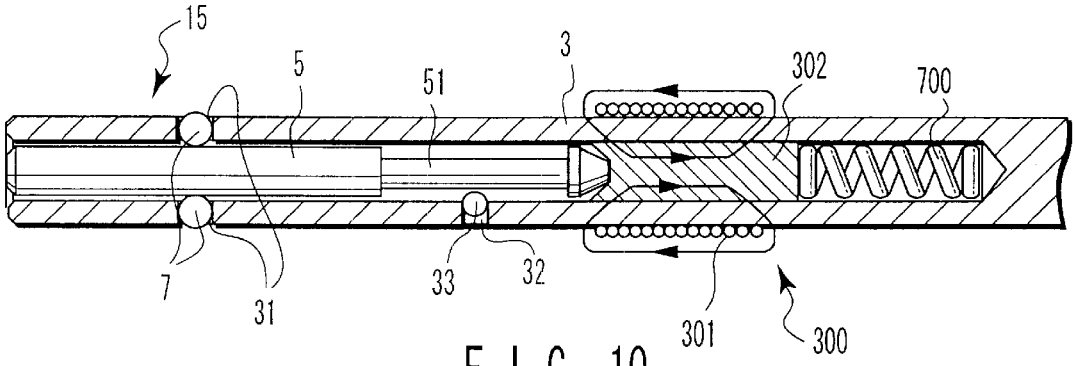
FIG. 10 is a longitudinal cross sectional view showing a modified embodiment of the component rolling tool in accordance with the seventh embodiment of the present invention.

In this case, in accordance with this embodiment, in the same manner as that of the first embodiment, it is also possible to provide with the moving roller stopping mechanism for preventing the moving roller 5 from slipping out from the center hole of the sleeve 3, as shown in FIG. 10.

(Eighth Embodiment)

Figure 11:
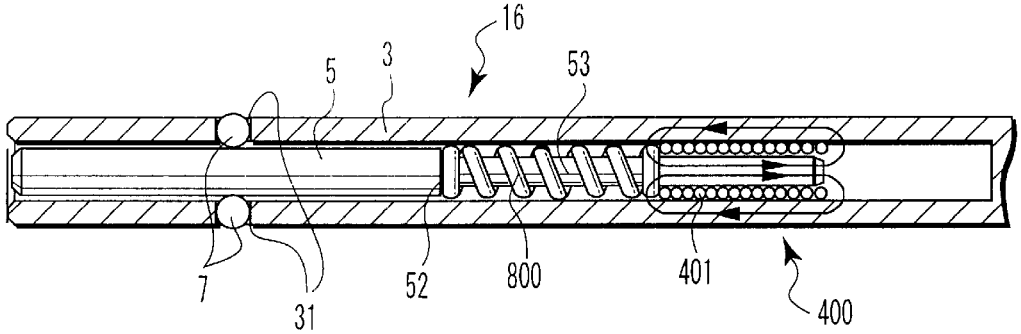
FIG. 11 is a longitudinal cross sectional view of a component rolling tool in accordance with an eighth embodiment of the present invention.

A description will be given below of a component rolling tool 16 of a dynamic pressure groove in accordance with an eighth embodiment of the present invention with reference to FIG. 11. The component rolling tool 16 in accordance with the present embodiment further has an urging member 800 for moving the moving roller 5 due to an urging force in addition to the same elements as those in accordance with the fourth embodiment shown in FIG. 5. In this case, the same reference numerals are attached to the same elements as the elements of the component rolling tool 12 of the dynamic pressure groove in accordance with the fourth embodiment of the present invention mentioned above with reference to FIG. 5, and a detailed description thereof will be omitted.

The urging member 800 is provided such that a rear end is fixed to the front end of the coil 401 within the center hole of the sleeve 3 and a front end is brought into contact with a step portion 52 of the moving roller 5 at the initial position. The urging member 800 is, for example, a compression coil spring. A small diameter portion 53 of the moving roller 5 is inserted into the urging member 800 and the coil 401. The initial position mentioned above corresponds to a position at which the moving roller 5 can move to both sides along the axis, in the same manner as the initial position in accordance with the fifth embodiment shown in FIG. 6. Further, the initial position corresponds to a position at which the moving roller 6 can press the component rolling ball 7 outward in the radial direction toward the guide hole 31 near the center in the longitudinal direction of the other portions than the small diameter portion thereof.

Here, a description will be given of an operation of the component rolling tool 16 in accordance with the present embodiment. In the component rolling tool 16 in accordance with the present embodiment, in the same manner as the operation of the component rolling tool 12 in accordance with the fourth embodiment shown in FIG. 5, a first groove forming step and a first releasing step are executed. In this case, in the present embodiment, the moving roller 7 is brought into contact with the outer peripheral surface near the center in the longitudinal direction of the moving roller 5. Accordingly, the pressure contact portion on the outer peripheral surface of the moving roller 5 with which the component rolling ball 7 is in pressure contact in the first groove forming step is only the rear half portion of the outer peripheral surface of the moving roller 5. When the first grooving step is finished, the first releasing step is executed. Then, the first returning step is executed.

In a first returning step in accordance with the present embodiment, in the same manner as that of the returning step in accordance with the fourth embodiment mentioned above, at first, the electric current is applied to the coil 401 so as to generate a magnetic force. Subsequently, in this step, the small diameter portion 53 of the moving roller 5 is attracted within the coil due to a magnetic force, and the moving roller 5 is returned to the initial position shown in FIG. 11. In accordance with the attraction executed by the returning apparatus 400, the small diameter portion 53 is completely inserted into the coil 401, whereby the magnetic field of the returning apparatus 400 becomes stable and the attraction force becomes 0, so that the movement of the moving roller 5 is finished. When the movement is finished, the electric current applied to the coil 401 is shut.

At this time, there is a case that the moving roller 5 backward urged by the returning apparatus 400 excessively moves rearward along the longitudinal center axis from the initial position. In this case, the urging member 800 presses back the moving roller 5 forward. As a result, the moving roller 5 again returns to the same initial position as that before starting the component rolling process, and is again returned to the state capable of moving to both sides along the longitudinal center axis.

Subsequently, in the same manner as that of the fourth embodiment, the second groove forming step is executed. At this time, the moving roller 5 moves in the backward moving direction while pressing the urging member 800. Accordingly, the urging member 800 becomes in a compressed state. In this case, at a time of starting the second groove forming step, the moving roller 5 returns to the initial position as mentioned above. Therefore, the pressure contact portion with which the component rolling ball 7 is in pressure contact during the movement in the backward moving direction is only the front half portion of the outer peripheral surface of the moving roller 5 opposite to that in the case of the first groove forming step. When the first returning step is finished, the second groove forming step is executed.

Subsequently, in the same manner as that of the fourth embodiment, the second releasing step is executed. When the second releasing step is finished, the second returning step is executed.

In the second returning step in accordance with the present embodiment, since the load to the moving roller 5 applied by the component rolling ball 7 is cancelled at the same time when the second releasing step is finished. Accordingly, the urging member 800 compressed in the second groove forming step is restored so as to press back the moving roller 5 to the initial position. As a result, the moving roller 5 is again returned to the same initial position as that before starting the component rolling process so as to be again returned to the state capable of moving to both sides along the longitudinal center axis.

As mentioned above, due to the component rolling tool 14, it is possible to achieve a state in which the dynamic pressure groove can be formed in the same manner as the preceding forming process of the dynamic pressure bearing immediately before forming the next dynamic pressure groove, and the dynamic pressure groove can be continuously applied to the bearing hole 91 in an always uniform state.

As mentioned above, since the pressure contact portion of component rolling balls 7 in the moving roller 5 is different between the forward forming process and the backward forming process, the contact portion of the moving roller 5 becomes double. Therefore, it is possible to prevent the moving roller 5 from being rapidly abraded and it is possible to stably roll the dynamic pressure groove for a long time.

Figure 12:
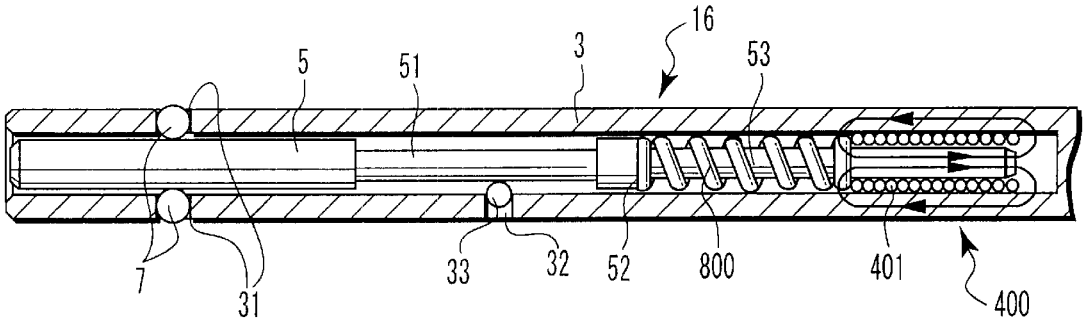
FIG. 12 is a longitudinal cross sectional view showing a modified embodiment of the component rolling tool in accordance with the eighth embodiment of the present invention.

In this case, in accordance with this embodiment, in the same manner as that of the first embodiment, it is also possible to provide with the moving roller stopping mechanism for preventing the moving roller 5 from slipping out from the center hole of the sleeve 3, as shown in FIG. 12.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A component rolling tool for applying a dynamic pressure groove within a bearing hole of a dynamic pressure bearing comprising:

component rolling balls;

cylindrical sleeve having an outer surface, an axis, a radius, a center hole, and a plurality of guide holes holding and allowing the component rolling balls to rotate and radially protrude out from the outer surface respectively, and being inserted into the bearing hole, and being relatively translated along the axis with respect to the bearing, and being relatively rotated about the axis with respect to the bearing;

a rod-like moving roller coaxially inserted to the center hole of the sleeve, pressing the component rolling balls toward an outward direction of the guide holes and being moved along the axis in accordance with a pressure contact rotation between the component rolling balls and an inner peripheral surface of the bearing hole caused by a relative movement between the sleeve and said dynamic pressure bearing; and a returning apparatus for returning the moving roller to an initial position at a desired timing in a state that the component rolling ball is released from a pressure contact with the inner peripheral surface.

2. A component rolling tool as claimed in claim 1, wherein the center hole of the sleeve is open in at least one end of the sleeve, and the returning apparatus presses the moving roller along the axis of the sleeve from a side of the open end.

3. A component rolling tool as claimed in claim 1, wherein the center hole is closed in at least one end of the sleeve, and the returning apparatus controls a pressure of a space between the closed end within the center hole and the moving roller.

4. A component rolling tool as claimed in claim 1, wherein the returning apparatus generates an electromagnetic force.

5. A component rolling tool as claimed in claim 1, wherein the component rolling tool has a moving roller stopping mechanism, and the moving roller stopping mechanism includes a combination of a convex portion provided on any one of the moving roller and the inner peripheral surface of the center hole in the sleeve and a recess portion provided on the other of the moving roller and the inner peripheral surface, and engages the convex portion and the recess portion with each other so as to stop a movement of said moving roller, when the moving roller moves at a predetermined distance from the initial position of the sleeve.

6. A component rolling tool for applying a dynamic pressure groove within a bearing hole of a dynamic pressure bearing comprising:

component rolling balls;

cylindrical sleeve having an outer surface, an axis, a radius, a center hole, and a plurality of guide holes holding and allowing the component rolling balls to rotate and radially protrude out from the outer surface respectively, and being inserted into the bearing hole, and being relatively translated along the axis with respect to the bearing, and being relatively rotated about the axis with respect to the bearing;

a rod-like moving roller coaxially inserted to the center hole of the sleeve, arranged at a predetermined initial position, capable of moving to both sides along the axis at the initial position, pressing the component rolling balls toward an outward direction of the guide holes and being moved to both directions along the axis from the initial position in accordance with a pressure contact rotation between the component rolling ball and an inner peripheral surface of the bearing hole caused by a relative movement between the sleeve and the dynamic pressure bearing; and a returning apparatus for returning the moving roller to the initial position at a desired timing in a state that the component rolling ball is released from a pressure contact with the inner peripheral surface.

7. A component rolling tool as claimed in claim 6, wherein said returning apparatus is provided in both sides along the axis within the center hole, and includes an urging member for urging the moving roller toward the initial position.

8. A component rolling tool as claimed in claim 6, wherein the center hole is closed in at least one end of the sleeve, and the returning apparatus controls a pressure of a space between the closed end within the center hole and the moving roller.

9. A component rolling tool as claimed in claim 8, wherein the returning apparatus further has an urging member for urging the moving roller toward the initial position.

10. A component rolling tool as claimed in claim 6, wherein the returning apparatus generates an electromagnetic force.

11. A component rolling tool as claimed in claim 10, wherein the returning apparatus further has an urging member for urging the moving roller toward the initial position.

12. A component rolling tool as claimed in claim 6, wherein said component rolling tool has a moving roller stopping mechanism, and the moving roller stopping mechanism includes a combination of a convex portion provided on any one of the moving roller and the inner peripheral surface of the center hole in said sleeve and a recess portion provided on the other of the moving roller and the inner peripheral surface of the center hole, and engages the convex portion and the recess portion with each other so as to stop a movement of the moving roller, when the moving roller moves at a predetermined distance from the initial position of the sleeve.

13. A method of applying a component rolling process, which uses a component rolling tool, of a dynamic pressure groove to a bearing hole of a dynamic pressure bearing, wherein the component rolling tool includes, component rolling balls; cylindrical sleeve having an outer surface, an axis, a radius, a center hole, and a plurality of guide holes, each of which rotatably holds each of the component rolling balls in a state of protruding outward; and a rod-like moving roller for pressing the component rolling balls toward the outer surface so that the rolling balls are protruded from the outer surface, the rod-like moving roller being inserted coaxially into the sleeve so as to be allowed to rotate about the axis and reciprocate along the axis;

said component rolling method of the dynamic pressure groove comprises:

a first groove forming step of forming the dynamic pressure groove by providing a first translational rotary relative motion between the sleeve and the bearing to introduce and advance the sleeve into and through the bearing hole in a first direction, and bringing the component rolling balls protruding from the sleeve in pressure contact with the inner peripheral surface of the bearing hole;

a first releasing step of releasing the component rolling balls from the contact with the inner peripheral surface;

a second groove forming step of forming the dynamic pressure groove by providing a second translational rotary relative motion, which is opposite in direction to the first relative motion, between the sleeve and the bearing to draw down and make the sleeve retreat from the bearing hole in a second direction opposite to the first direction, and bringing the component rolling balls protruding from the sleeve in pressure contact with the inner peripheral surface of the bearing hole;

a second releasing step of releasing the component rolling balls from the contact with the inner peripheral surface; and a returning step of returning the moving roller, moved in accordance with said first and second groove forming steps, to a predetermined initial position.

14. A method of applying a component rolling process of a dynamic pressure groove to a dynamic pressure bearing using a component rolling tool, wherein the component rolling tool includes, component rolling balls; cylindrical sleeve having an outer surface, an axis, a radius, a center hole, and a plurality of guide holes holding and allowing the component rolling balls to rotate and radially protrude out from the outer surface respectively; and a rod-like moving roller for pressing the component rolling balls toward the outer surface so that the rolling balls are protruded from the outer surface, the rod-like moving roller being inserted coaxially into the sleeve so as to be allowed to rotate about the axis and reciprocate along the axis;

said component rolling method of the dynamic pressure groove comprises:

a first groove forming step of forming the dynamic pressure groove by providing a first translational rotary relative motion between the sleeve and the bearing to introduce and advance the sleeve into and through the bearing hole in a first direction, and bringing the component rolling balls protruding from the sleeve in pressure contact with the inner peripheral surface of the bearing hole;

a first releasing step of releasing the component rolling balls from the contact with the inner peripheral surface;

a first returning step of returning the moving roller, moved in accordance with the first groove forming step, to a predetermined initial position;

a second groove forming step of forming the dynamic pressure groove by providing a second translational rotary relative motion, which is opposite in direction to the first relative motion, between the sleeve and the bearing to draw down make the sleeve retreat from the bearing hole in a second direction opposite to the first direction, and bringing the component rolling balls protruding from the sleeve in pressure contact with the inner peripheral surface of the bearing hole;

a second releasing step of releasing the component rolling balls from the contact with the inner peripheral surface; and a second returning step of returning the moving roller, moved in accordance with said second groove forming steps, to a predetermined initial position.

* * * * *